United States Patent [19]

Laird et al.

[11] 4,391,169

[45] Jul. 5, 1983

[54] CUTTER WITH ANGULAR BLADES AND METHOD FOR CUTTING ROPE THEREWITH

[75] Inventors: William F. Laird; Kenneth A. Wood, both of Kingston, Canada

[73] Assignee: Hartford Fibres, Ltd., Ontario, Canada

[21] Appl. No.: 176,917

[22] Filed: Aug. 11, 1980

[51] Int. Cl.[3] ..... D10G 1/04

[52] U.S. Cl. ..... 83/37; 83/341; 83/346; 83/913

[58] Field of Search ..... 83/37, 38, 341, 342, 83/346, 347, 913, 310, 673–675

[56] References Cited

U.S. PATENT DOCUMENTS

| | | | |
|---|---|---|---|
| 558,063 | 4/1896 | Gordon | 83/673 X |
| 1,577,621 | 3/1926 | Gammeter | 83/346 X |
| 1,825,250 | 9/1931 | Rehak | 83/310 X |
| 2,167,916 | 8/1939 | Taylor et al. | 83/913 X |
| 2,278,032 | 3/1942 | Youngman | 83/913 X |
| 2,664,160 | 12/1953 | Speakman | 83/341 |
| 2,808,884 | 10/1957 | Shann et al. | 83/342 X |
| 3,831,473 | 8/1974 | Fleissner | 83/913 X |
| 3,915,042 | 10/1975 | Laird | 83/341 |
| 3,992,967 | 11/1976 | Fram | 83/913 X |
| 4,083,279 | 4/1978 | Wester | 83/913 X |
| 4,120,222 | 10/1978 | Potter | 83/913 X |
| 4,161,897 | 7/1979 | Nakazawa | 83/913 X |
| 4,237,758 | 12/1980 | Lindner et al. | 83/346 X |
| 4,287,799 | 9/1981 | Fujita | 83/347 |

*Primary Examiner*—James M. Meister
*Attorney, Agent, or Firm*—Austin R. Miller

[57] ABSTRACT

A cutter is provided for cutting rope into fibers of the same or varying lengths. A plurality of blades are provided having cutting edges arcuately arranged and facing either inwardly or outwardly. Rope is fed against the cutting edges and through the spaces between them. The cutting blades are parallel to each other and are obliquely arranged with respect to a plane passing through all of the cutter blades. In a preferred embodiment, the blades are equally spaced from each other so that the resulting cut products comprises a multiplicity of cut fibers which all have approximately the same length. Also disclosed is a novel reel structure comprising a pair of superposed blade support rings with a coaxial hub member extending therebetween and providing support therefor. A plurality of spokes extend radially from the hub and are connected to at least one of the blade support rings.

21 Claims, 10 Drawing Figures

CUTTER WITH ANGULAR BLADES AND METHOD FOR CUTTING ROPE THEREWITH

BACKGROUND OF THE INVENTION

1. Field of the Invention

This invention relates to a cutter apparatus for cutting rope into a plurality of cut fibers, and to a method of cutting. More particularly, the invention relates to an apparatus and method employing a plurality of spaced apart cutting blades in a substantially closed configuration, with the blades facing either inwardly or outwardly. In accordance with this invention, the blades are parallel to each other and are obliquely arranged with respect to a central plane dissecting all of the blades. The resulting cut fibers are preferably of staple lengths in the range of about 2 mm to 150 mm or even more or less.

2. Discussion of the Prior Art

Rope cutters have heretofore been provided which result in either the formation of fibers having approximately the same length, or fibers of varying lengths.

For instance, in U.S. Pat. No. 3,915,042 (Laird), of common assignment herewith, a cutter is provided for cutting rope into fibers of varying lengths. A plurality of blades are provided and have cutting edges which are arcuately arranged and face either inwardly or outwardly. Rope is then fed against the cutting edges of the blades forcing the rope against the cutting edges and through the spaces between them. The edges of the blades are angularly arranged with respect to each other to vary the distances between adjacent cutting edges along the lengths of adjacent blades so that when the rope is cut, the resulting cut fibers have varying lengths in proportion to the distance between the cutting edges at the point of cutting. As may be seen from review of this patent, all of the cutting edges are not parallel to one another.

A precision cutter is disclosed in U.S. Pat. No. 3,861,257 (Laird et al), of common assignment herewith, wherein the resulting fibers are all of uniform length. A plurality of blades are provided and have cutting edges which are arcuately arranged and face inwardly. Rope is fed within the curve and pressed against the edges of the blade, forcing the rope outwardly against the cutting edges. The bodies of the cutting blades diverge outwardly in the direction taken by the cut fibers and the cut fibers are conveyed by a fluid such as air to a collecting chamber or the like.

Other patents directed toward cutting apparatus and the like, include: U.S. Pat. Nos. 2,631,668 (Wicker); 3,485,120 (Keith); 3,557,648 (Coffin et al); 3,744,361 (Van Doorn et al); 3,768,355 (Farmer et al); 3,826,163 (Spaller, Jr. et al); 3,831,481 (Van Doorn et al); 3,948,127 (Vehling et al); and 4,063,479 (Roncato).

In those devices which are characterized by the provision of a plurality of parallel spaced blades which are perpendicular to a centrally disposed plane passing therethrough, the rope or tow mass which is to be cut thereby often bulges up behind the pressure wheel device causing extreme side pressure on the blades. This extreme pressure chips the fine edges of the blades, greatly reducing their life and in some cases, causes blade breakage. Also, in these prior art devices, when cutting fibers to relatively short lengths, the fibers tend to pack about the cutting edges, causing the cutter to jam. Furthermore, in certain instances, heat builds up in these devices due to frictional, and other factors, which heat tends to deform the fibers, if they are thermoplastic, so that small fiber crimps in the form of "V"s or the like are formed in the fibers as they attempt to pass through the agglomeration of fibers disposed about the blades.

Accordingly, there remains a need in the rope cutting art for the production of a rope cutting apparatus, which minimizes fiber agglomeration at the cutting blade locations. Of particular importance is the need for a rope cutter which can provide for cut fibers of two millimeters or less, wherein this agglomeration phenomenon does not occur.

In addition to the above, there is a need in the art for a cutting apparatus of the type which will not deform the cut fibers, which deformation often occurs when the fibers have difficulty passing through the spaces between adjacent blades.

Accordingly, it is an object of the present invention to provide a rope cutting mechanism wherein fiber agglomeration at the blade locations is minimized, thus resulting in longer blade life, reduced unwanted deformation of the fibers, and an over-all increase in production speed.

These and other objects and advantages of the invention will further appear hereinafter in conjunction with the drawings and following detailed description of the invention.

DRAWINGS

DETAILED DESCRIPTION OF THE INVENTION

Figure 1:
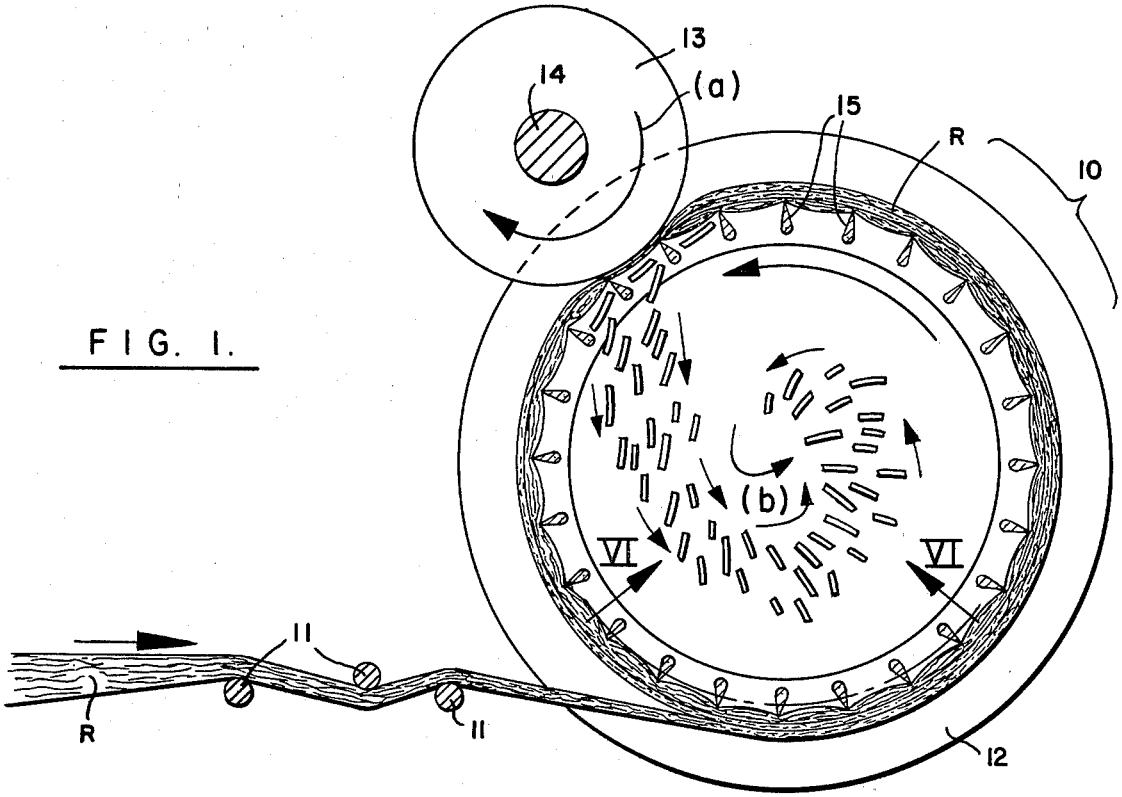
FIG. 1 is a view in side elevation of a rope cutter apparatus constructed in accordance with this invention with many parts removed in order to reveal important details.

Although this description will utilize specific terms in the interest of clarity, it is to be understood that these terms are used in reference to the specific forms of the invention selected for illustration in the drawings, and are not intended to limit the scope of the invention, which is defined in the appended claims.

As used in connection with this invention the term "rope" is intended to include an elongated bundle of filaments, usually of the synthetic filament type, such as nylon, polyester, etc., arranged substantially parallel to each other and having a reasonably uniform thickness along its length. The filaments of the rope may either be continuous or discontinuous, or may be the same as each other or a blend of different fibers. They may be the same denier or may have different deniers, and may include natural fibers or synthetic fibers alone or blended with each other. Although the most frequently used form of rope is continuous filament tow, this term is also intended to included garnetted waste, piddled filament waste yarns, garnetted sliver filaments and natural fibers, carded sliver, braided or twisted rope and the like. Preferably in accordance with this invention the rope is a tow which may be laid out flat, so that it assumes the shape of a band having a width which is considerably greater than its thickness.

Turning now to FIG. 1 of the drawings, the number 10 comprehensively designates a cutter apparatus for cutting the rope R which is fed continuously from any convenient source, not shown, over and under the flattening rods 11 in a manner to decrease the thickness of the rope while concurrently increasing its width, for a reason which will be described in further detail hereinafter. The number 12 designates a reel which is constructed to be driven in rotation about its center in a continuous manner and at a regulatable velocity of rotation. The rod 11 closest to reel 12 serves as a guide for the rope R. Located adjacent to the reel 12 is a pressure roller 13 which is rotatable about its axis 14 in the direction indicated by the arrow (a) appearing in FIG. 1. Means are provided of a conventional nature, not shown, for pressing the roller 13 against the rope R which is wrapped repeatedly over and upon itself on the reel 12, as shown in FIG. 1.

The number 15 designates a plurality of cutter blades which are spaced apart from one another and arranged with their cutting edges facing radially outwardly. It will be apparent that the pressure of the roller 13, bearing upon the outermost layer of rope R, transmits a pressure through the outer layer of rope R and forces the innermost layer of rope R against the adjacent cutting edges, causing the rope to be cut into staple length fibers F. These staple length cut fibers F are then mixed with one another in the turbulent air within the ring of blades, as indicated by the arrows (b) in FIG. 1, thus causing an intimate admixture of the cut fibers. As stated, a conventional air conveying system, not shown in FIG. 1 of the drawings, is desirably utilized to draw the cut fibers out of the space within the reel 12 and to convey them to a suitable destination such as a fiber collecting bin, for example.

Figure 2:
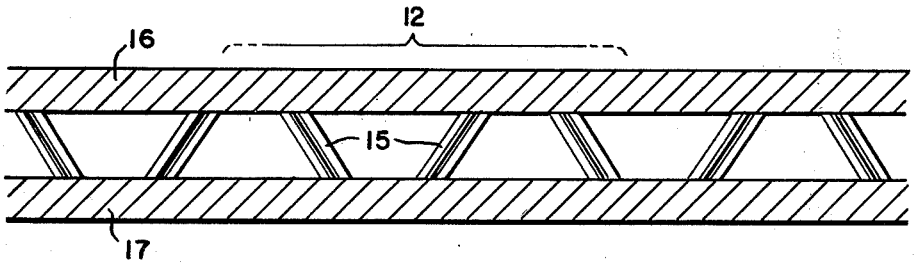
FIG. 2. (PRIOR ART)
FIG. 2 is an end view of one prior art cutting blade arrangement.

FIG. 2 of the drawings shows one prior art arrangement wherein the blades 15 are angularly arranged with respect to each other. Specifically, the cutting edges of each adjacent pair of blades 15 are not parallel to each other and are disposed at angles to each other, such that the distance between the cutting edges varies across the path of the rope R.

Figure 3:
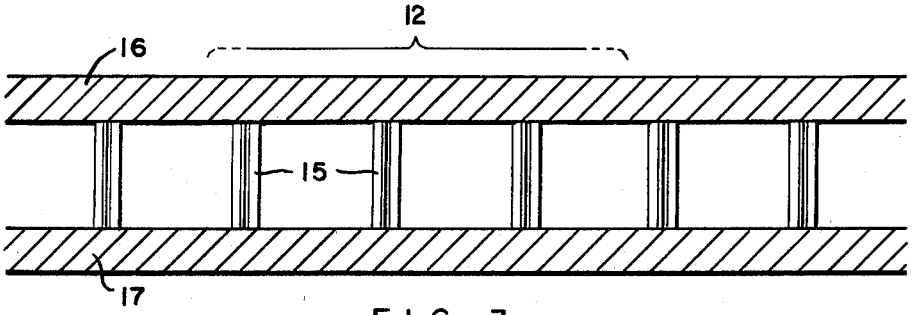
FIG. 3. (PRIOR ART)
FIG. 3 is an end view of another prior art cutting blade arrangement.

FIG. 3 shows yet another prior art blade arrangement wherein the blades 15 are all parallel to each other, and are perpendicularly disposed with respect to a central plane passing therethrough. This prior art arrangement suffers the disadvantage of fiber agglomeration, decreased blade life, and fiber deformation, previously mentioned.

Figure 6:
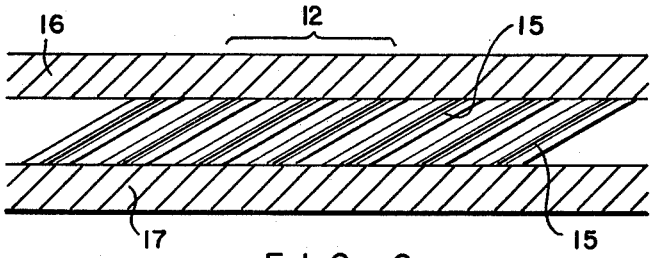
FIG. 6 is a sectional view taken as indicated by the lines and arrows VI—VI which appear in FIG. 1, this sectional view being considerably enlarged as compared to FIG. 1.

Turning to FIG. 6, the blade arrangement of the present invention is therein shown. As shown in this figure, the reel 12 includes a pair of blade support rings 16, 17, which extend circularly completely around the reel and which constitute the supporting means upon which the blades are mounted. It will be appreciated that rope R, which has been flattened and widened into a band by the rods 11 appearing in FIG. 1, occupies the entire space between the ring 16 and the ring 17. Similarly, the thickness of the pressure roll 13 is equal to the distance between the rings 16, 17, so that the pressure roll 13 exerts pressure on the rope all the way across the intervening space between the rings 16, 17, in other words, all along the lengths of the blades 15. The blades 15, are each parallel with respect to the other blades in the array, and are arranged at an oblique angle, preferably 45°, to a central plane dissecting all of the blades.

Figure 7:
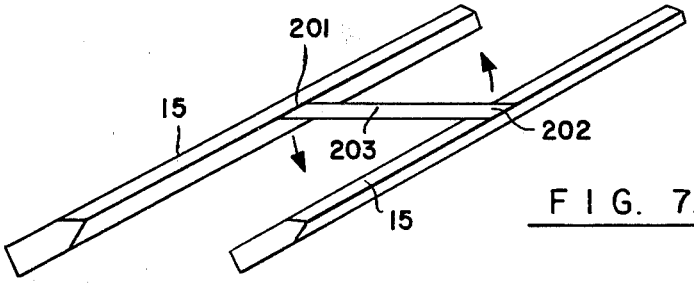
FIG. 7 is an enlarged view showing two of the cutting blades depicted in FIG. 6, with a cut fiber being pressed between the edge portions of the blades.

During the cutting of the fibers, and with attention being drawn to the enlarged view of the cutter blade arrangement of the present invention shown in FIG. 7, it can be seen that both edges 201, 202 of the fiber are cut in parallel manner, and at the same angle. As fiber 203 is being cut, due to the oblique, parallel dispositions of the blades 15, it tends to ride down the beveled edge of the blade appearing at the left hand side of FIG. 7, causing the fiber to rotate parallel with the cutting edges, so that it may be easily affected by the air conveying system, without agglomeration, fiber deformation, and undue wear on the cutting blades. This is in sharp contrast to fibers processed or devices having blade arrangements as shown in FIGS. 2 and 3, which tend to promote fiber agglomeration at the cutting edge locations.

It is to be understood that when the reel 12 and the pressure roll 13 are rotated, the pressure roll 13 forces the rope against the staggered edges of the blades 15 (shown in FIGS. 6 and 7), cutting the rope into a multiplicity of cut fibers wherein each fiber is angularly cut at both of its terminal end portions and wherein the angular cut portions of the same fiber are parallel to each other. Moreover, in conjunction with the blade arrangement shown within FIGS. 6 and 7, the cut fibers all have approximately the same length, and the cut angle existing along the terminal end portions of the fiber is approximately 45°.

The blades shown in FIG. 6 are equally spaced from each other. However, it is within the purview of the present invention that the blades may be dissimilarly spaced, thus resulting in the production of an intimate mix of cut fibers of varying lengths, wherein the terminal portions of the fibers are cut at an angle, with both of the terminal cut portions being parallel to each other.

Figure 8:
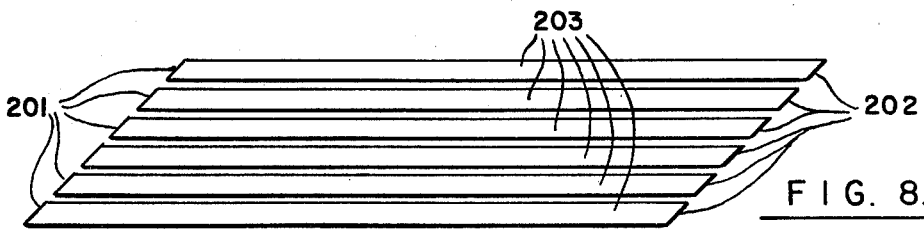
FIG. 8 is a side view of a multiplicity of cut fibers, produced by the apparatus of the present invention.

FIG. 8 discloses a multiplicity of cut fibers 203, which have been processed in accordance with the blade arrangement shown in FIG. 6. It is to be noted that the ends 201, 202 of the fibers 203, are angularly cut, and are parallel to each other.

It is to be noted that the entire reel 10 may be removed as a unit and replaced with another reel. In this manner, adjustments may be made quickly with respect to different spacings between the blades, and different angles of inclination. Changing of the reels or adjustment of the blades allows the operator to produce assorted blends of cut fibers. Similarly, some blades may even be omitted, and it is possible, as above noted to even vary the distances in a random or predetermined pattern, between the adjacent pairs of blades themselves. In this manner, a wide variety of products may be obtained with certainty.

The number of wraps of uncut rope R that are trained around the cutting edges may be varied at will, and depends of course upon the pressure roll 13. However, it is preferred to space the pressure wheel at least far enough away that it cannot damage the cutting edges of the blades. There should normally be at least a partial layer of uncut infeeding rope R in the intervening space between the pressure roll 13 and the arc in which the cutting edges lie.

Figure 4:
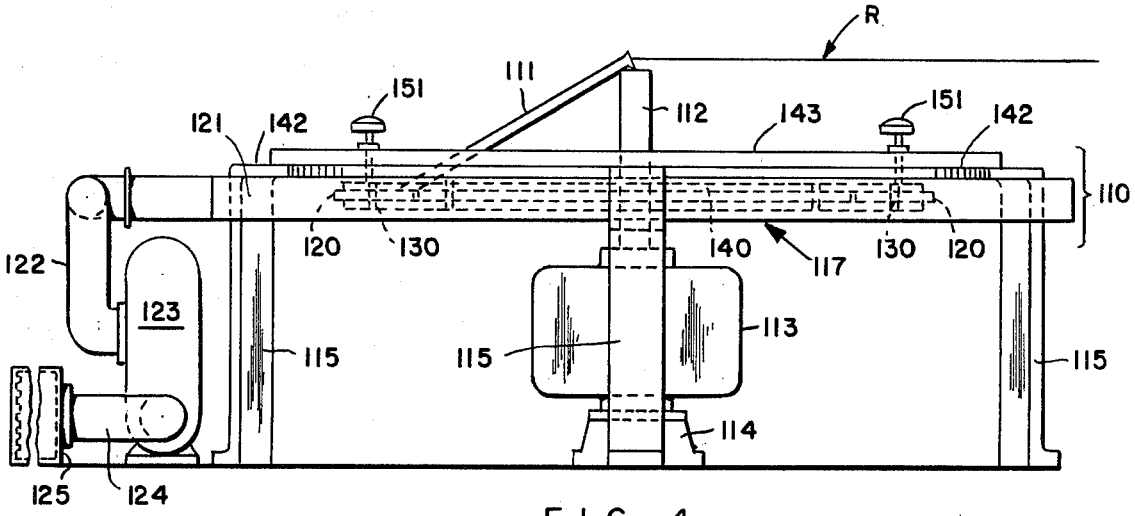
FIG. 4 is a side view of another flock or staple cutter in accordance with the present invention, arranged to cut from inside out.

Turning now to FIG. 4 of the drawings, the number 110 comprehensively designates a precision cutter apparatus for cutting the rope R which is fed continuously from any convenient source, not shown, through a feed tube 111 which is arranged for rotation about a main drive shaft 112 which is driven in rotation by a variable speed motor 113 mounted upon a motor support 114. The cutter apparatus 110 is supported by vertical supports 115, 115 and includes a plurality of inwardly facing blades 116, circularly arranged with all cutting edges facing inwardly toward the feed tube 111. A pressure disc 117 is also mounted for rotation about the shaft 112, driven by the motor 113 and carrying a multiplicity of spaced apart pressure wheels 120, having a structure and function which will be referred to in further detail hereinafter. As will appear hereinafter, the pressure disc 117 comprises upper and lower spaced discs 140, 140 between which the pressure wheels 120 are located. However, at this point it should be stated that the pressure wheels 120 are constructed and arranged to press the rope R outwardly against the cutting edges of the blades 116, causing the blades to cut the rope, and forcing the rope generally radially outwardly into an annular chamber 121 which surrounds the disc 117 and blades 116 and is connected to ductwork 122 leading to the feed end of a blower 123 having an outlet duct 124 leading into a collection chamber 125 for the cut flock. Openings are provided inwardly of the ring of cutter blades 116 for admitting a fluid such as air into the suction chamber 121. Thus, the blower 123 draws air into the annular chamber 121, causing the air to flow radially outwardly through the spaces between the blades 116, entraining the cut fibers and carrying them through the ductwork 122 and through the blower 123 and outlet duct 124 into the collection chamber 125, thus delivering the cut fibers for collection and ultimate shipment. It will be appreciated that collection chamber 125 is preferably a cyclone separator. The internal blade arrangement is exactly that as shown in FIGS. 6 and 7 with the exception that the cutting edges of the blades face inwardly.

Figure 5:
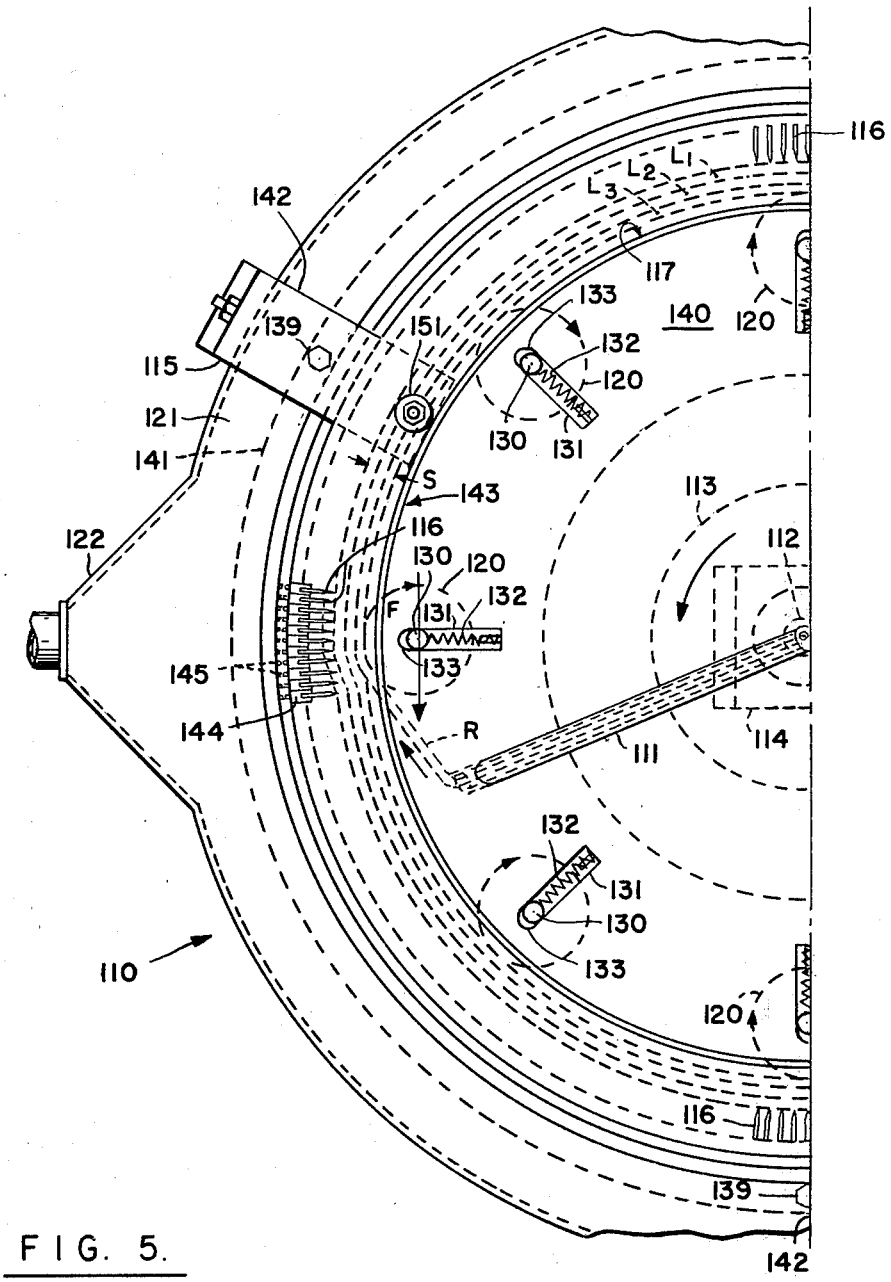
FIG. 5 is an enlarged plan view of one-half of the apparatus appearing in FIG. 4.

Turning to FIG. 5 of the drawings, further details are shown with respect to the manner in which the outwardly directed rope cutting portion of the apparatus is constructed and operated. As will be observed in FIG. 5, the feed tube 111 is rigidly mounted upon the disc 117 and swings around with it. The rope R passes through the tube 111 and over the curved surface of one of the pressure wheels 120. Each pressure wheel 120 has a central shaft 130 which rides in slots 131, 131 formed in the spaced discs 140, 140 of the pressure disc 117. A spring 132, continuously maintained in compression, urges the shaft 130 radially outwardly, causing pressure contact between the pressure wheel 120 and the rope R. All of the pressure wheels 120 are similarly constructed and mounted and are maintained by their springs 132 continuously in pressure contact with the rope R.

Each slot 131, however, has an adjustable limit stop 133, at its outer extremity, limiting the permissible extent of movement of the shaft 130 in a radially outward direction, thus assuring that there will always be a spacing S between the maximum radius of the path of movement of the pressure wheels 120, and the radius of the circle defined by the locus of the cutting edges of blades 116. Although the magnitude of the spacing S is not critical, it is preferred to allow enough spacing so that at least a portion of the thickness of one layer of rope is always uncut, and lies in the space provided by the spacing S.

It will be appreciated from FIG. 5 that, as the drive shaft 112 rotates under the influence of the motor 113, rope is distributed around the periphery of the pressure disc 117, in between the cutting edges and the pressure wheels 120, building into one or a plurality of layers in the intervening space S. As the rope is thus trained around in one or in multiple layers within the periphery of the cutting blades 116, the pressure wheels 120 rotate in the direction indicated by the arrows thereon.

In the embodiment shown in FIG. 5, the spacing S is such that three layers of uncut rope have been provided, these being designated L1, L2 and L3 in the upper portion of FIG. 5. In view of the fact that the spacing S is not wide enough to accommodate more than three layers of rope between the cutting blades 116 and the pressure wheel 120 without building up excessive pressure wheel 120 forces the rope against the cutting blades with such a high pressure that the outer layer L1, which is in contact with the cutting edges of the blades 116, is cut into individual sections of precise dimension. These cut sections, which are designated as flock F in FIG. 5, are then caused to move radially outwardly under the pressure of successively cut layers L2 and L3, and are caught up in the air stream previously described and conveyed to the collection chamber 125 which may be a standard cyclone collector or bag collector, for example.

The rope R, of course, may be of any denier at all. With smaller denier such as 10,000 or less, it is preferable to use a larger number of layers of uncut rope in the intervening space, but with deniers of 250,000 to 500,000 or more, a lesser number of such uncut layers (such as part of one or up to two) is considered more practical.

It will be appreciated that the rope R may be cut while wet, if desired, and the wet cut fibers may be conveyed away either by air or by some other fluid, or even by mechanical means.

It is to be noted, that in conjunction with utilization of the blade arrangement shown in FIGS. 6 and 7, extremely small spacing between the adjacent blades may be provided. For instance, blade spacings on the order of two millimeters or even less, are possible in accordance with the blade arrangement shown in FIGS. 6 and 7 due to the fact that the cut fibers do not tend to agglomerate about the blade edges, due to the rotational phenomenon as shown in FIG. 7.

Figure 9:
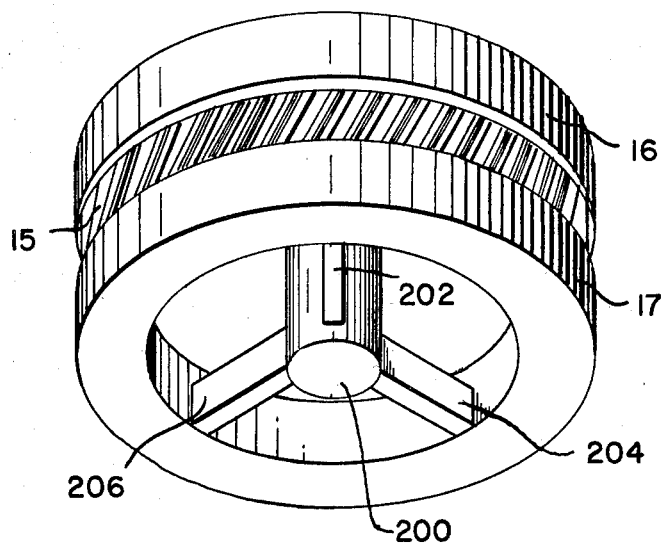
FIG. 9 is a perspective view from the bottom of one embodiment of a reel structure in accordance with the invention.
Figure 10:
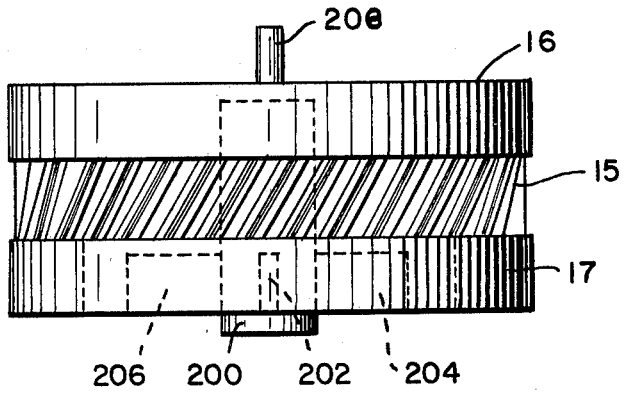
FIG. 10 is a side elevational view of the reel shown in FIG. 9.

FIGS. 9 and 10 depict a reel, which has been found to be advantageous, especially when preparing staple fibers on the order of ¼ inch or less. As shown in FIGS. 9 and 10, the blade support rings 16, 17, are spaced from each other and supported by means of hub 200 and spokes 202, 204, 206, emanating from hub 200 and connected to blade support ring 17. Oftentimes, in prior art devices wherein the blade support rings were supported by an annular arrangement of posts or the like located behind the blades, small cut fibers would tend to jam or agglomerate at the post location, decreasing the overall efficiency of the cutting apparatus. As shown in FIG. 9, a drive shaft 208 is formed in the top portion of hub 200, to serve as suitable connection to a driving mechanism (not shown). It has been found that by use of the reel structure as shown in FIGS. 9 and 10, the tendencies of small cut fibers to jam has been greatly minimized.

Although this invention has been described with reference to certain specific embodiments thereof, it will be appreciated that various modifications may be made, including the substitution of equivalent elements for those shown and described. Further, the invention comprehends the use of certain features independently of other features; for example, it is possible to generate cutting pressure by any means other than the pressure roll 13 or pressure rolls 120, and in some cases the rope R has adequate geometry as delivered, and need not be flattened out in the manner illustrated and described in connection with FIG. 1 of the drawings. Further, it is apparent that this invention is fully applicable to a cutter which cuts in the opposite direction to that shown in FIG. 1, namely a cutter having blades which face inwardly and having a pressure means which forces the fiber outwardly for cutting between the blades (FIGS. 4 and 5). Other modifications include the reversal of parts, the substitution of equivalent elements, and other modifications which may be made without departing from the spirit and scope of the invention as defined in the appended claims.

We claim:

1. In a cutter for cutting a rope or the like into a plurality of cut fibers, said cutter comprising a support means, a plurality of spaced apart cutting blades in substantially adjacent configuration mounted in said support means, said blades having cutting edges adapted to contact said rope, guide means for guiding the rope to said support means to distribute a layer of said rope along a predetermined path adjacent said cutting blades, and pressure means for pressing said rope into contact with said cutting blades so as to cut said rope and force it through the spaces between the blades, the improvement wherein said cutting edges are disposed in substantially parallel relation to each other and are arranged obliquely with respect to said predetermined path of the rope and are also arranged obliquely with respect to a central plane passing through said predetermined path, whereby fibers undergo angular bodily swinging movement after cutting and while passing through the spaces between the blades.

2. Cutter as recited in claim 1 wherein said support means comprises a pair of superposed rings and wherein said cutting blades extend between and are supported by said pair of rings.

3. Cutter as recited in claim 1 wherein said blades are disposed on generally a 45° angle relative to said plane.

4. Cutter as recited in claim 1 wherein means are provided for flattening out the rope as it is sent to said cutter.

5. Cutter as recited in claim 4 wherein said flattening means is arranged to direct said flattened rope so that its width's direction extends generally along the length's direction of said blades.

6. Cutter as recited in claim 2 wherein said blades and rings are in the form of a reel which is removeable as a unit from said cutter.

7. Cutter as recited in claim 1 wherein said blades are substantially circularly arranged and wherein said blades face outwardly.

8. Cutter as recited in claim 1, wherein said blades are arranged substantially circularly, and wherein said cutting edges face inwardly.

9. Cutter as recited in claim 1, wherein said blades are all spaced equidistantly from each other.

10. In a cutter wherein a rope containing a multiplicity of fibers is laid out lengthwise against a plurality of cutting blades which are spaced apart from one another and is cut by said blades, the novel combination with said apparatus which comprises positioning means for maintaining said blades at an angle to the lengthwise orientation of said rope and at an angle to a line perpendicular thereto while said rope is being cut, all of said blades being angled toward the same side of the perpendicular, and pressure means for pressing said rope into contact with said cutting blades so as to cut said rope and force it through the spaces between the blades whereby fibers of said rope undergo angular bodily swinging movement after cutting and while passing through the spaces between the blades.

11. In a method of cutting a rope wherein said rope is laid out lengthwise against a plurality of cutting blades which are spaced apart from one another, and which is cut into fibers by forcing the rope against the cutting edges of the blades and forcing the cut fibers through the spaces between the blades, the step which comprises cutting said rope while maintaining said blades at an angle to the lengthwise orientation of said rope at an angle to a line perpendicular thereto, and with all of said blades angled toward the same side of the perpendicular, thereby causing the fibers to undergo angular bodily swinging movement after cutting and while passing through the spaces between the blades.

12. Method as recited in claim 11 further comprising arranging said blades in substantially parallel relation to each other.

13. Method as recited in claim 12 comprising arranging said blades along generally a 45° angle relative to a central plane passing through all of said blades.

14. Method as recited in claim 11 further comprising the step of flattening out the fibers as they are sent to said cutter.

15. Method as recited in claim 11 further comprising mounting said blades between a pair of superposed ring members whereby said cutting blades extend between and are supported by said pair of rings, providing said rings in the form of a reel which is removeable as a unit from the cutter apparatus.

16. Method as recited in claim 11 further comprising arranging said blades in a substantially circular configuration and wherein all said blades face radially outwardly.

17. Method as recited in claim 11 comprising arranging said blades in a substantially circular configuration and wherein said blades face radially inwardly.

18. Method as recited in claim 11 comprising spacing said blades equidistantly from each other other.

19. In a cutter apparatus for cutting rope or the like into a plurality of cut fibers wherein a plurality of spaced apart cutting blades are disposed in substantially adjacent configuration and are mounted between a pair of superposed blade support rings, and wherein means are provided for pressing the rope against said blades to cut the rope into fibers and to force said fibers through the spaces between said blades, the improvement comprising a hub member coaxially disposed with respect to said blade support rings and extending therebetween to support said blade support rings to support said blades at an angle to the lengthwise orientation of said rope at an angle to a line perpendicular thereto, with all the blades angled toward the same side of the perpendicular, thereby causing the fibers to undergo angular bodily swinging movement after cutting and while passing through the spaces between the blades, and a plurality of spoke members extending radially from said hub and being connected to one of said blade support rings.

20. In a cutter apparatus as defined in claim 19 further comprising a drive shaft coaxially disposed with respect to said hub and protruding from one of said blade support rings.

21. In a cutter for cutting a rope or the like into a plurality of cut fibers, said cutter comprising a support means, a plurality of spaced apart cutting blades in substantially adjacent configuration mounted in said support means, said blades having cutting edges adapted to contact said rope, guide means for guiding the rope to said support means to distribute a layer of said rope adjacent said cutting blades, and pressure means for pressing said rope into contact with said cutting blades so as to cut said rope and force it through the spaces between the blades, the improvement wherein said cutting edges are disposed in substantially parallel relation to each other and said cutting edges are arranged obliquely with respect to a central plane passing therethrough, whereby fibers of said rope undergo angular bodily swinging movement after cutting and while passing through the spaces between the blades and wherein said support means comprises a pair of superposed rings with said cutting blades extending between and being supported by said pair of rings, a hub member coaxially disposed with respect to said blade support rings and extending therebetween to support said blade support rings, and a plurality of spoke members extending radially from said hub and being connected to one of said rings.

* * * * *